US009689585B2

(12) United States Patent
Norrell et al.

(10) Patent No.: US 9,689,585 B2
(45) Date of Patent: Jun. 27, 2017

(54) METHOD OF ADAPTIVE CONTROL OF A BYPASS DAMPER IN A ZONED HVAC SYSTEM

(71) Applicant: Trane International Inc., Piscataway, NJ (US)

(72) Inventors: Billy W. Norrell, Tyler, TX (US); Gregory S. Brown, Flint, TX (US); John Tanner Taylor, Flint, TX (US); Jonathan David Douglas, Hurst, TX (US)

(73) Assignee: Trane International Inc., Piscataway, NJ (US)

( * ) Notice: Subject to any disclaimer, the term of this patent is extended or adjusted under 35 U.S.C. 154(b) by 426 days.

(21) Appl. No.: 14/535,767

(22) Filed: Nov. 7, 2014

(65) Prior Publication Data

US 2015/0060037 A1 Mar. 5, 2015

Related U.S. Application Data

(62) Division of application No. 13/077,756, filed on Mar. 31, 2011.

(51) Int. Cl.
*F24F 11/02* (2006.01)
*F24F 11/04* (2006.01)
(Continued)

(52) U.S. Cl.
CPC ..... *F24F 11/022* (2013.01); *F24F 3/044* (2013.01); *F24F 7/08* (2013.01); *F24F 11/001* (2013.01);
(Continued)

(58) Field of Classification Search
CPC ..... F28F 27/02; F24F 11/022; F24F 11/043; F24F 11/053; F24F 2011/0042
(Continued)

(56) References Cited

U.S. PATENT DOCUMENTS 4,487,363 A * 12/1984 Parker ..... F24F 11/0009 165/205
4,732,318 A * 3/1988 Osheroff ..... F24F 3/0442 165/217
(Continued)

OTHER PUBLICATIONS

Canadian Office Action; Application No. 2,769,288 dated Nov. 5, 2013; 2 pages.
(Continued)

*Primary Examiner* — Devon Russell
(74) *Attorney, Agent, or Firm* — Conley Rose, P.C.; J. Robert Brown, Jr.; Michael J. Schofield

(57) ABSTRACT

A zoned HVAC system comprises an HVAC unit including a climate control system and an air mover. In addition, the system comprises a supply air duct in fluid communication with the outlet of the HVAC unit. Further, the system comprises a return air duct in fluid communication with the inlet of the HVAC unit. Still further, the system comprises a plurality of zones positioned between the supply air duct and the return air duct. Moreover, the system comprises a bypass duct extending between the supply air duct and the return air duct. The bypass duct includes an active bypass damper having an open position, a closed position, and a plurality of partially opened positions. The system also comprises a control device configured to control the position of the bypass duct.

15 Claims, 5 Drawing Sheets

(51) Int. Cl.

| | |
|---|---|
| ***F24F 13/14*** | (2006.01) |
| ***F24F 7/08*** | (2006.01) |
| ***F24F 11/053*** | (2006.01) |
| ***F24F 3/044*** | (2006.01) |
| *F24F 11/00* | (2006.01) |

(52) U.S. Cl.
CPC ..... *F24F 11/0076* (2013.01); *F24F 11/043* (2013.01); *F24F 11/053* (2013.01); *F24F 13/1426* (2013.01); *F24F 11/0012* (2013.01); *F24F 2011/0041* (2013.01); *F24F 2011/0042* (2013.01); *F24F 2011/0056* (2013.01)

(58) Field of Classification Search
USPC ..... 700/276, 278; 165/217, 234, 280, 279, 165/282, 284, 293, 294, 100, 198
See application file for complete search history.

(56) References Cited

U.S. PATENT DOCUMENTS 4,829,447 A * 5/1989 Parker ..... G05D 23/1393 165/205
4,841,733 A * 6/1989 Dussault ..... F24F 5/0071 165/223
5,249,596 A * 10/1993 Hickenlooper, III .. F24F 11/022 137/334
5,305,953 A * 4/1994 Rayburn ..... F24D 19/1084 165/217
5,971,067 A * 10/1999 Rayburn ..... F24F 11/0017 165/217
6,089,464 A 7/2000 Morgan
6,105,927 A 8/2000 Zelczer et al.
6,154,686 A * 11/2000 Hefferen ..... B08B 15/023 454/59
6,298,912 B1 * 10/2001 Rayburn ..... F24F 11/0076 165/217
6,827,142 B2 * 12/2004 Winkler ..... G05D 23/1393 165/247
6,997,390 B2 2/2006 Alles
7,119,308 B2 * 10/2006 Kopel ..... F24H 9/2071 219/494
7,178,545 B2 * 2/2007 Zelczer ..... G05D 7/03 137/115.07
7,188,779 B2 * 3/2007 Alles ..... F24F 3/0442 165/205

OTHER PUBLICATIONS

Canadian Office Action; Application No. 2,769,288 dated Sep. 15, 2014; 2 pages.

* cited by examiner

METHOD OF ADAPTIVE CONTROL OF A BYPASS DAMPER IN A ZONED HVAC SYSTEM

CROSS-REFERENCE TO RELATED APPLICATIONS

This is a divisional application of the prior filed and co-pending U.S. patent application Ser. No. 13/077,756 filed on Mar. 31, 2011 by Billy W. Norell, et al., entitled "Method of Adaptive Control of a Bypass Damper in a Zoned HVAC System," the disclosure of which is hereby incorporated by reference in its entirety.

STATEMENT REGARDING FEDERALLY SPONSORED RESEARCH OR DEVELOPMENT

Not applicable.

BACKGROUND

The invention relates generally to heating, ventilation, and air conditioning (HVAC) systems. More particularly, the invention relates to bypass ducts and associated bypass dampers that allow excess air in the HVAC system to recirculate. Still more particularly, the present invention relates to determining and using the actual flow rate of bypass air as a variable for use in controlling the bypass damper.

A conventional zoned central HVAC system includes an HVAC unit that conditions air (e.g., heats or cools the air, or otherwise improves comfort or health-related characteristics of the air such as by ventilation, filtration or humidity control), a supply duct that flows the conditioned air from the HVAC unit, and it may also include a return duct that provides air to the HVAC unit for conditioning. The supply and return ducts, if present, are split into two or more branches. Each branch delivers conditioned air to a zone (i.e., portion of the building) from the supply duct. If a return duct is present air is withdrawn from the zones and passes directly to the HVAC unit. Otherwise the air is returned to the HVAC unit by passing through the zones of the structure due to the location of the unit and its lower inlet pressure. Usually, each supply duct branch is fitted with one or more adjustable automatic dampers that independently control the flow rate (e.g., ft3/m, cubic feet per minute or CFM) of air flowing to its corresponding zone as directed by the HVAC controller based on the comfort needs of the occupants of each zone. For example, a damper may be adjusted between a fully open position, a partially open position, or closed position depending on the desired flow rate of conditioned air to be supplied to the corresponding zone.

Some conventional zoned central HVAC systems also include a bypass duct with a partially opened bypass damper that allows a portion of the total flow rate of conditioned air output by the HVAC unit, referred to as bypass air, to bypass all the building zones and recirculate back to the HVAC unit. The purpose of the bypass air is to provide a path for excess air in the system. Excess air typically occurs when the total flow rate of conditioned air generated by the HVAC unit is greater than the total flow rate of conditioned air needed by or allowed to flow to the zones. An excess air condition may occur because of overly restrictive supply ducts, return ducts, or branches thereof, or because of one or more zone dampers being partially or fully closed to reduce the flow of conditioned air into the respective zones. Undesirable effects of excess air include air noise, high pressure in the system, reduced total air flow or overly conditioned air (e.g., conditioned air that is heated to a high temperature or cooled to a lower temperature than during normal system operation).

The bypass duct and bypass damper provide a path for such excess air, which helps reduce and/or eliminate the aforementioned problems associated with excess air. However, too much bypass air (i.e., excessive recirculation) is also undesirable. For example, excess recirculation of cooled air could freeze coils in the HVAC unit, and excess recirculation of heated air could result in air temperatures that are sufficiently high to overheat the HVAC unit or trip protective controls and shut down the HVAC unit. Thus, the flow rate of bypass air must be limited. Typically, the flow rate of bypass air is limited by (1) a recommended maximum bypass air flow rate (cubic feet per minute or CFM) or (2) a recommended maximum recirculation percentage (i.e., maximum percentage of the nominal flow rate generated by the HVAC unit).

Unfortunately, the actual flow rate of bypass air in most conventional zoned HVAC systems is not known, and cannot be controlled because the bypass damper is not adjustable or it is adjusted solely based on pressure. Rather, most conventional bypass ducts and dampers are designed for a fixed maximum air flow rate at assumed, fixed conditions. For example, the bypass damper is selected to achieve recommended maximum bypass air flow rate or maximum recirculation percentage based on an assumed constant, fixed maximum air flow rate generated by the HVAC unit. However, in reality, the flow rate of bypass air on a given zoned HVAC system may vary greatly as the pressure differential between the supply duct and the return duct varies. The differences in air pressure in the supply duct and the air pressure in the return duct may vary greatly due to different modes of operation of the HVAC unit, varying duct restrictions (e.g., due to clogged filters, debris accumulation in the ducts, etc.), and adjustments in various zone dampers. Moreover, the air flow rate delivered by the HVAC unit may also vary for the same reasons. Due to differences between the actual flow rate of bypass air and the designed flow rate of bypass air based on assumed conditions, undesirable excess recirculation may occur.

Accordingly, there remains a need in the art for improved systems and methods for controlling the flow rate of bypass air in a zoned HVAC system. Such systems and methods would be particularly well-received if they allowed for adaptive control and adjustment of the flow rate of bypass air based on actual conditions in the HVAC system.

SUMMARY OF THE DISCLOSURE

These and other needs in the art are addressed in one embodiment by a zoned HVAC system. In an embodiment, the zoned HVAC system comprises an HVAC unit including a climate control system configured to control the properties of a flow of air passing through the HVAC unit and an air mover adapted to create a pressure differential between an inlet and an outlet of the HVAC unit. In addition, the zoned HVAC system comprises a supply air duct in fluid communication with the outlet of the HVAC unit. Further, the zoned HVAC system comprises a return air duct in fluid communication with the inlet of the HVAC unit. Still further, the zoned HVAC system comprises a plurality of zones positioned between the supply air duct and the return air duct. Each zone includes a climate controlled space. Moreover, the zoned HVAC system comprises a bypass duct extending between the supply air duct and the return air duct. The bypass duct includes an active bypass damper having an open position, a closed position, and a plurality of partially opened positions. The zoned HVAC system also comprises a control device configured to control the position of the bypass duct.

These and other needs in the art are addressed in another embodiment by a method for controlling a bypass damper in a zoned HVAC system. In an embodiment, the method comprises (a) flowing conditioned air from an HVAC unit to a plurality of zones and a bypass duct including the bypass damper. The bypass damper has an open position, a closed position, and a plurality of partially open positions. In addition, the method comprises (b) flowing a portion of the conditioned air through the bypass duct and the bypass damper, the conditioned air flowing through the bypass damper having an actual flow rate. Further, the method comprises (c) determining the actual flow rate of the conditioned air flowing through the bypass damper. Still further, the method comprises (d) adjusting the position of the bypass damper based on the actual flow rate of the conditioned air flowing through the bypass damper These and other needs in the art are addressed in another embodiment by a method for controlling a flow of bypass air in a zoned HVAC system. In an embodiment, the method comprises (a) flowing conditioned air from an HVAC unit to a plurality of zones and a bypass duct including the bypass damper. The bypass damper has an open position, a closed position, and a plurality of partially open positions. In addition, the method comprises (b) flowing a first portion of the conditioned air through the bypass duct and the bypass damper. Further, the method comprises (c) flowing a second portion of the conditioned air through one or more of the zones. Still further, the method comprises (d) measuring a pressure differential across the HVAC unit. Moreover, the method comprises (e) comparing the measured pressure differential across the HVAC unit to a predetermined pressure differential. The method also comprises (f) adjusting the flow of the first portion of the conditioned air during (e). In addition, the method comprises (g) measuring a temperature of the conditioned air flowing from the HVAC unit. Further, the method comprises (h) comparing the measured temperature to a predetermined upper supply air temperature limit and a predetermined lower supply air temperature limit after (e). Moreover, the method comprises (i) adjusting the flow rate of the first portion of the conditioned air during (h).

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a more complete understanding of the present disclosure and the advantages thereof, reference is now made to the following brief description of the drawings, taken in connection with the accompanying drawings and detailed description, wherein like reference numerals represent like parts.

DETAILED DESCRIPTION

Figure 1:
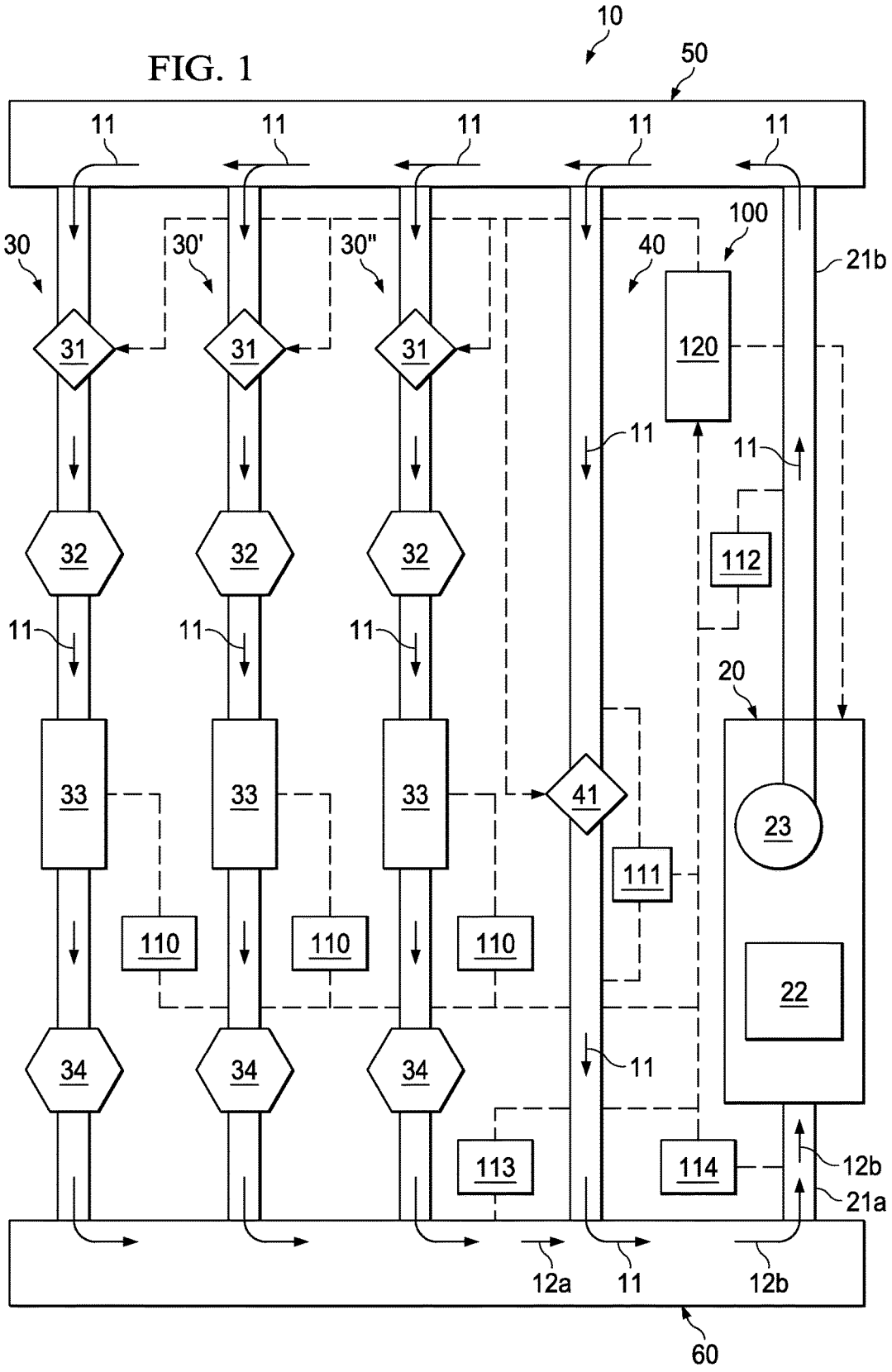
FIG. 1 is a schematic view of an embodiment of a zoned HVAC system in accordance with the principles described herein.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In general, flow rates of air (e.g., supply air, conditioned, air, heated air, recirculation air, etc.) in an HVAC system are expressed as volumetric flow rates of air (e.g., ft3/m, cubic feet per minute, or CFM). Thus, as used herein, the "flow rate" of air refers to the volumetric flow rate of the air. In addition, the difference in pressure across a component (i.e., between the inlet and outlet of a component such as a damper or HVAC unit) is referred to as a "pressure differential." In general, a pressure differential may be based on the difference between the inlet static pressure and outlet static pressure, the inlet velocity pressure and outlet velocity pressure, or the inlet total pressure and the outlet total pressure. In general, the total pressure at a particular region is the sum of the static pressure in the region and the velocity pressure in the region. Thus, the inlet total pressure is the sum of the inlet static pressure and the inlet velocity pressure, and the outlet total pressure is the sum of the outlet static pressure and the outlet velocity pressure.

Referring now to FIG. 1, an embodiment of a zoned central HVAC system 10 is schematically shown. HVAC system 10 includes a central HVAC unit 20, a plurality of zones 30, 30', 30", and a bypass duct 40. HVAC unit 20 having an air inlet 21*a* and an air outlet 21*b*. In addition, HVAC unit 20 includes a climate control system 22 and an air mover 23. Air enters HVAC unit 20 at inlet 21*a*, passes through climate control system 22, then passes through air mover 23 and exits unit 20 at outlet 21*b*.

Climate control system 22 adjusts and controls the properties of the air flowing through HVAC unit 20. The properties that may be adjusted and controlled by climate control system 22 include, without limitation, the air temperature, the air quality (e.g., purity, cleanliness, etc.), humidity (i.e., the amount of water vapor in the air), or combinations thereof. For instance, climate control system 22 may include a heater or furnace to increase the air temperature, an air conditioner to decrease the air temperature, an air filtration or exhaust system to improve air quality, and a humidity control system to adjust humidity.

Air mover 23 generates a pressure differential across HVAC unit 20 sufficient to circulate air through system 10. Namely, air mover 23 creates a relatively low pressure region at inlet 21*a* that sucks air into HVAC unit 20 and creates a relatively high pressure region at outlet 21*b* that pushes air out of HVAC unit 20. In this embodiment, air mover 23 is a blower or fan. A supply duct or plenum 50 extends from outlet 21*b* to each zone 30, 30', 30" and bypass duct 40. Air from HVAC unit 20 is supplied to each zone 30, 30', 30" and bypass duct 40 via outlet 21*b* and supply duct 50. A return duct or plenum 60 extends from each zone 30, 30', 30" and bypass duct 40 to inlet 21*a*. Air from each zone 30, 30', 30" and bypass duct 40 returns to HVAC unit 20 via return duct 60 and inlet 21*a*.

Referring still to FIG. 1, in this embodiment, each zone 30, 30', 30" is configured the same. Specifically, each zone 30, 30', 30" includes a zone damper 31, a supply register 32, a conditioned space 33, and a return register 34. Each zone damper 31 controls the flow rate (e.g., m3/s) of air flowing from supply duct 50 into its respective conditioned space 33 through supply register 32. In this embodiment, each zone damper 31 is an active damper that is automatically adjusted to vary the flow rate of conditioned air 11 flowing into its corresponding space 33. For example, the position of each zone damper 31 may be independently controlled to (a) completely block air flow into its respective zone 30, 30', 30" in a closed position, (b) allow the maximum flow of air into its respective zone 30, 30', 30" in a fully open position, or (c) allow a limited flow of air into its respective zone 30, 30', 30" in a partially opened position. Return registers 34 provide a flow path between spaces 33 and return duct 60. In particular, air from each space 33 flows through its corresponding return register 34 into return duct 60, and then flows through return duct 60 to inlet 21*a* of HVAC unit 20.

Bypass duct 40 extends between supply duct 50 and return duct 60. In particular, bypass duct 40 has an inlet coupled to supply duct 50 and an outlet coupled to return duct 60. Bypass duct 40 allows excess air supplied by HVAC unit 20 to bypass each and every zone 30, 30', 30" of system 10. Excess air typically arises when the total flow rate of air input into supply duct 50 by HVAC unit 20 is greater than the total flow rate of conditioned air needed or allowed to flow into zones 30, 30', 30" of system 10. For example, if dampers 31 limit the total flow rate of air flowing through zones 30, 30', 30" to 2.25 CFM and HVAC unit 20 is supplying 2.5 CFM of air to supply duct 50, then the total flow rate of excess air is 0.25 CFM. Since the excess air passing through bypass duct 40 bypasses all the zones zone 30, 30', 30" of system 10, it may also be referred to as "bypass air." As previously described, excessive flow of bypass air through bypass duct 40 may damage or inhibit the operation of HVAC unit 20. Thus, in this embodiment, the flow rate of bypass air flowing through bypass duct 40 is limited by a selectively active bypass damper 41 that is automatically adjusted to vary the flow rate of air flowing through bypass duct 40. For example, the position of bypass damper 41 may be controlled to (a) completely block bypass air flow through bypass duct 40 in a closed position, (b) allow a maximum flow of bypass air through bypass duct 40 in a fully opened position, or (c) allow a limited flow of bypass air through bypass duct 40 in a partially opened position. As will be described in more detail below, the flow rate of bypass air flowing through bypass duct is limited to either (a) a predetermined maximum bypass air flow rate (CFM), or (b) a predetermined maximum recirculation percentage (i.e., a predetermined maximum percentage of the nominal air flow rate generated by HVAC unit 20).

As previously described, climate control system 22 adjusts and controls the properties of the air exiting HVAC unit 20 via outlet 21*b*. Accordingly, the air supplied by HVAC unit 20 may also be referred to as "conditioned" air. In FIG. 1, the conditioned air is denoted with reference numeral 11. The conditioned air 11 flows through supply duct 50 into zones 30, 30', 30" and bypass duct 40. Within spaces 33, conditioned air 11 mixes with existing or "unconditioned" air in spaces 33 to adjust the overall air temperature, quality, and humidity in spaces 33. Accordingly, the air flowing from each space 33 into return duct 60, which is a mixture of conditioned air 11 and unconditioned air in each space 33, typically has properties different than conditioned air 11 provided by HVAC unit 20. For example, if the conditioned air 11 has a temperature of 68° F., and the unconditioned air in each space 33 has a temperature of 75°, the air flowing through each return register 34 will typically have a temperature greater than 68°. However, the bypass air flowing through bypass duct 40 bypasses zones 30, 30', 30", and thus, has the same or substantially the same properties as the conditioned air 11. Therefore, the bypass air may also be described as "conditioned" air (e.g., conditioned air 11).

In general, the air returning to HVAC unit 20 through return duct 60 is referred to as "return" air. Upstream of bypass duct 40, the return air includes only the air flowing from spaces 33 of zones 30, 30', 30" into return duct 60, and thus, may be referred to as "zone" return air, which is denoted with reference numeral 12*a* herein. Downstream of bypass duct 40, the return air comprises a mixture of the zone return air 12*a* and the conditioned air 11 flowing from bypass duct 40 into return duct 60, and thus, may be referred to as "mixed" return air, which is denoted with reference numeral 12*b* herein.

Referring still to FIG. 1, HVAC system 10 also includes a control system 100 that regulates and controls the operation of system 10. In this embodiment, control system 100 includes a plurality of zone air sensors 110, a bypass pressure differential sensor 111, a supply air temperature sensor 112, a zone return air temperature sensor 113, a mixed return air temperature sensor 114, and a control device 120. Zone air sensors 110 measure the properties (e.g., temperature, humidity, quality, CO2, etc.) of the air in zone spaces 33. In this embodiment, one zone air sensor 110 is provided for each zone space 33. Bypass pressure differential sensor 111 measures the pressure differential across bypass damper 41. In this embodiment, sensor 111 measures the static pressure differential across bypass damper 41 (i.e., the difference between the static pressure at the inlet of damper 41 and the static pressure at the outlet of damper 41), however, in other embodiments, the measured pressure differential across the bypass damper (e.g., damper 41) may be based on the difference between the velocity pressure at the inlet of the damper and the velocity pressure at the outlet of the damper, or based on the difference between the total pressure at the inlet of the damper and the total pressure at the outlet of the damper. Supply air temperature sensor 112 measures the temperature of the conditioned air 11. In this embodiment, supply air temperature sensor 112 measures the temperature of conditioned air 11 at outlet 21*b* of HVAC unit 20. Zone return air temperature sensor 113 is positioned to measure the temperature of the zone return air 12*a* upstream of bypass duct 40. Thus, in this embodiment, zone return air temperature sensor 113 is positioned along return duct 60 between zone registers 34 and the outlet of bypass duct 40. However, mixed return air temperature sensor 114 is positioned to measure the temperature of mixed return air 12*b* entering HVAC unit 20, which comprises a mixture of the zone return air from zones 30, 30', 30" and conditioned air 11 from bypass duct 40 as previously described. In this embodiment, mixed return air temperature sensor 114 is positioned to measure the temperature of the mixed return air 12*b* at inlet 21*a* of HVAC unit 20.

Sensors 110, 111, 112, 113, 114 communicate data to control device 120, and control device 120 communicates instructions to dampers 31, 41 and HVAC unit 20. In FIG. 1, the communication couplings between control device 120 and sensors 110, 111, 112, 113, 114, dampers 31, 41, and HVAC unit 20 are shown as dashed lines. In this embodiment, control device 120 is electronically coupled with each sensor 110, 111, 112, 113, 114, each damper 31, 41 and HVAC unit 20 with wires. However, in other embodiments, the control device (e.g., control device 120) may be wirelessly coupled with each of the sensors (e.g., each sensor 110, 111, 112, 113, 114), each damper (e.g., each damper 31, 41), and the HVAC unit (e.g., HVAC unit 20).

In general, control device 120 may be implemented as a processor, such as a general/special purpose digital signal processor circuit, a microcontroller, or microprocessor and associated software programming, or other circuitry adapted to perform the calculations and comparisons described herein, as well as control the operation of the various active components of the system (e.g., HVAC unit 20 and dampers 31, 41). The term processor as used herein generally refers to a computer central processing unit ("CPU"), embodiments of which comprise a control unit that fetches, decodes, and executes instructions, an arithmetic and logic unit ("ALU") that performs logical and mathematical operations, registers for storage of values used in processor operation, and various other logic. Some embodiments of a processor comprise volatile memory and/or non-volatile memory for storage of data and instructions. Some processor embodiments include circuitry configured to perform only certain specific computations or operations.

Control device 120 adjusts zone dampers 31 and HVAC unit 20, as appropriate, based on a comparison of the measured climate data from each zone air sensor 110 and the desired conditions (e.g., air temperature, air quality, humidity, etc.) in each space 33. The desired conditions in each space 33 are typically predetermined based on the comfort needs of the occupants of spaces 33 or the climate needs of the contents of spaces 33, and are programmed or input into a climate control input device (e.g., thermostat) and communicated to control device 120. Based on the comparison of the measured climate data and the desired conditions in each space 33, control device 120 adjusts the position of each damper 31 (e.g., closed, fully opened, partially opened, etc.), and controls HVAC unit 20 (e.g., on or off, heating or cooling, etc.), as appropriate, to achieve the desired conditions in each space 33. For example, if the actual temperature in one space 33, as measured with the corresponding zone air sensor 110, is below the desired temperature in that space 33, control device 120 will direct HVAC unit 20 to supply heated air and open zone damper 31 associated with that particular space 33 an appropriate amount. As will be described in more detail below, control device 120 also adjusts the position of bypass damper 41 (e.g., closed, fully opened, partially opened) based on the actual flow rate of bypass air flowing through bypass duct 40. For example, if the flow rate of bypass air flowing through bypass duct 40 is too high, control device 120 will direct bypass damper 41 to partially close or completely close.

Figure 2:
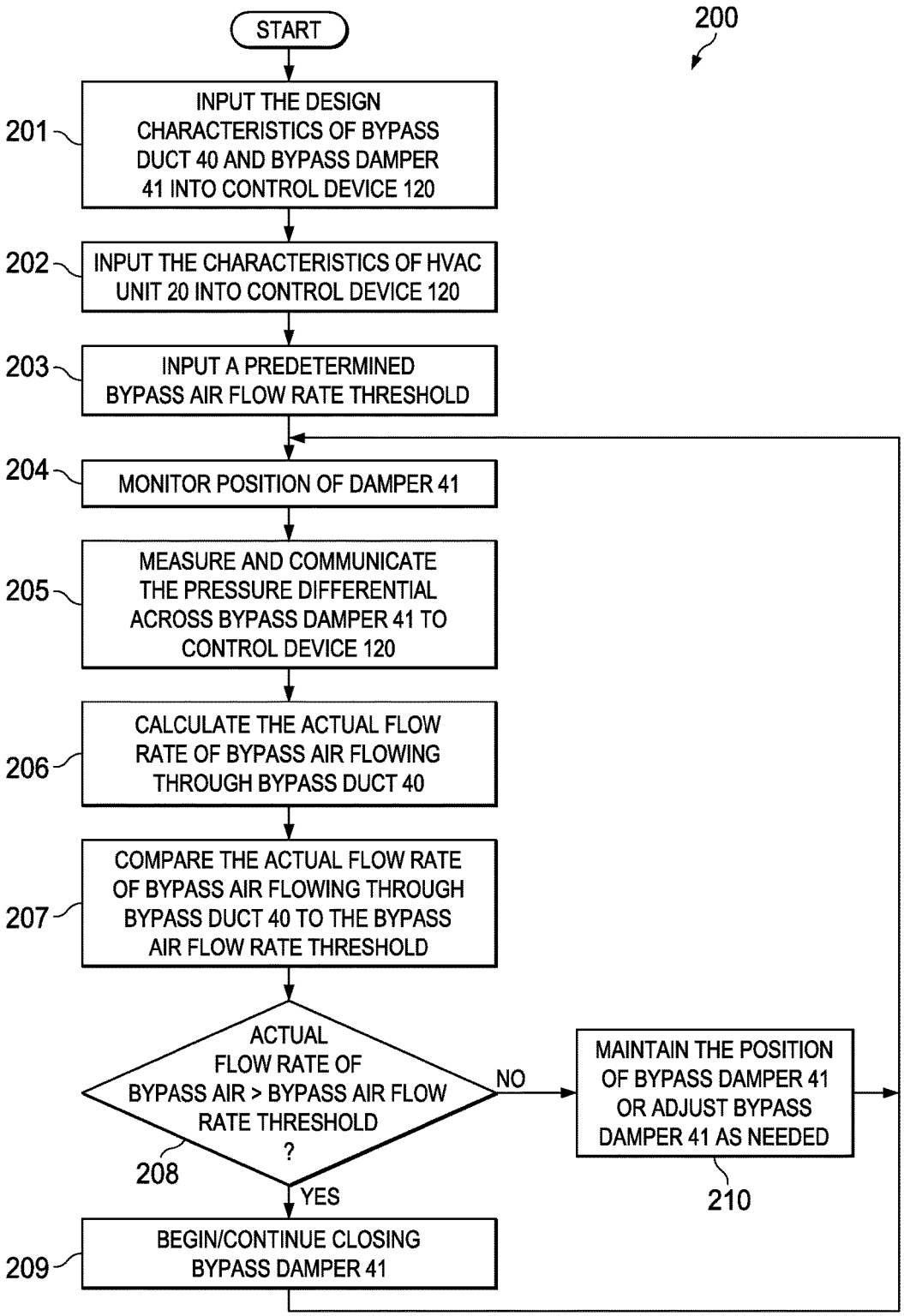
FIG. 2 is a schematic view of an embodiment of a method for automatically and adaptively controlling the active bypass damper of FIG. 1.

Referring now to FIG. 2, an embodiment of a method 200 for automated, adaptive control of the position of bypass damper 41 of HVAC system 10 is shown. In block 201 of method 200, the installer of HVAC system 10 (or technician servicing or maintaining HVAC system 10) inputs one or more design characteristics of bypass duct 40 and bypass damper 41 into control device 120. The design characteristics of duct 40 and damper 41 input into control device 120 include the characteristics of bypass duct 40 and bypass damper 41 necessary to determine the actual flow rate of bypass air flowing through bypass duct 40 according to block 206 described in more detail below using standard industry engineering equations and lookup tables (e.g., according to Air Conditioning Contractors of America® Manual D). In some cases, the design characteristics of bypass duct 40 and bypass damper 41 needed to determine the actual flow rate of bypass air flowing through bypass duct 40 will include the cross-sectional geometry of bypass duct 40 (e.g., round or rectangular), the length of bypass duct 40, the size of bypass duct 40 (e.g., diameter, width, or cross-sectional area), the number and type of fittings (bends and elbows, etc.) in bypass duct 40, the material properties of bypass duct 40, and the cross-sectional geometry of bypass damper 41 (e.g., rectangular or round). In other cases a single characteristic (e.g., a round duct diameter) may be sufficient needed to determine the actual flow rate of bypass air flowing through bypass duct 40. In addition, the installer or technician inputs the characteristics of HVAC unit 20 into control device 120 according to block 202. The design characteristics of HVAC unit 20 input into control device 120 include one or more characteristics of HVAC unit 20 necessary to determine the actual flow rate of bypass air flowing through bypass duct 40 according to block 206 described in more detail below using standard industry engineering equations and lookup tables (e.g., manufacturer's blower performance tables). In most cases, the design characteristics of HVAC unit 20 needed to determine the actual flow rate of bypass air flowing through bypass duct 40 will include the nominal air flow rate of HVAC unit 20. Still further, the installer or technician inputs a predetermined bypass air flow rate threshold into control device 120 according to block 203. In this embodiment, the bypass air flow rate threshold is (1) a recommended maximum bypass air flow rate, and/or (2) a recommended maximum recirculation percentage (i.e., maximum ratio of the bypass air flow rate to the nominal air flow rate generated by the HVAC unit 20 expressed as a percent). The recommended maximum bypass air flow rate and recirculation percentage depend on the system configuration and setup, and are preferably determined based on manufacturer's recommendations, experience, rules of thumb and application engineering calculations. The starting point is the nominal air flow rate of the HVAC unit, determined from the manufacturer's blower performance tables. Additional factors include the degree to which the blower speed is variable, the amount of conditioning capacity of the climate control system as compared to the nominal air flow rate, the characteristics of the supply and return ductwork; that is, how much air flow they are capable of handling at the pressure specified by the manufacturer and the range of supply air temperature tolerated by equipment and occupants. For example on a large air conditioning (cooling) unit with a small heating element and a single speed blower, the bypass limit might be 50% during heating operation but only 20% during cooling operation.

During operation of HVAC system 10, control device 120 monitors the position of bypass damper 41 according to block 204. In general, bypass damper 41 may be completely closed, fully opened, or at any number of partially opened positions. In addition, pressure differential sensor 111 measures the pressure differential across bypass damper 41, and communicate the measured pressure differential across bypass damper 41 to control device 120 according to block 205. Control device 120 receives the measured pressure differential across bypass damper 41, and uses this data in conjunction with the design characteristics of bypass duct 40 and the characteristics of HVAC unit 20 input in blocks 201 and 202, respectively, to calculate the actual flow rate of bypass air flowing through bypass duct 40 using standard industry engineering equations and lookup tables (e.g., according to Air Conditioning Contractors of America® Manual D) in block 206. In general, control device 120 may determine of the actual flow rate of bypass air flowing through bypass duct 40 continuously or on a periodic basis (e.g., once a minute). However, in this embodiment, the actual flow rate of bypass air flowing through bypass duct 40 is determined by control device 120 on a continuous, real time basis.

Moving now to block 207, control device 120 compares the actual flow rate of bypass air flowing through bypass duct 40 calculated in block 205 to the bypass air flow rate threshold input in block 203. If the bypass air flow rate threshold is a recommended maximum bypass air flow rate, control device 120 simply compares the actual flow rate of bypass air flowing through bypass duct 40 to the recommended maximum bypass air flow rate. However, if the bypass air flow rate threshold is a recommended maximum recirculation percentage, control device 120 must (a) calculate an "actual" recirculation percentage equal to the ratio of the actual flow rate of bypass air flowing through duct 40 to the nominal air flow rate generated by HVAC unit 20 input in block 202 (×100%); and then, (b) compare the actual recirculation percentage to the maximum recirculation percentage.

Based on the comparison of the actual flow rate of bypass air flowing through bypass duct 40 and the bypass air flow rate threshold input in block 207, control device 120 determines whether adjustment of the position of bypass damper 41 is necessary according to block 208. In particular, if the actual flow rate of bypass air flowing through bypass duct 40 calculated in block 205 is greater than the bypass air flow rate threshold input in block 203, then control device 120 instructs bypass damper 41 to at least partially close in block 209 to protect HVAC unit 20 from excessive recirculation. However, if the actual flow rate of bypass air flowing through bypass duct 40 calculated in block 205 is less than or equal to the bypass air flow rate threshold input in block 203, then no further closure of bypass damper 41 is necessary to protect HVAC unit 20 from excessive recirculation, and thus, control device 120 is free to maintain the position of bypass damper 41, or adjust bypass damper 41 as appropriate depending on the conditions in zones 30, 30', 30", as shown in block 210. Thus, it should also be appreciated that as long as the actual flow rate of bypass air flowing through bypass duct 40 is less than the bypass air flow rate threshold, control device 120 has the option to maintain the position of bypass damper 41, further open bypass damper 41, or further close bypass damper 41 depending on other operating conditions. For example, if one or more zone dampers 31 are opened further to enhance the supply of conditioned air 11 provided to spaces 33, bypass damper 41 may be closed to reduce the flow rate of bypass air and allow a greater percentage of the conditioned air 11 to flow to zones 30, 30', 30". However, if the actual flow rate of bypass air flowing through bypass duct 40 is substantially the same or equal to the bypass air flow rate threshold, then control device 120 has little to no flexibility to further open bypass damper 41 as a small increase in the flow rate of bypass air flowing through bypass duct 40 may result in excessive recirculation.

Following adjustment of bypass damper 41, as necessary, in blocks 209, 210, process 200 repeats again beginning with block 204. Thus, during installation and/or servicing of HVAC system 10, blocks 201, 202, 203 are performed to setup or initialize control device 120, however, during actual operation of HVAC system 10, blocks 204-210 are repeated in a closed loop fashion to adaptively control bypass damper 41 to prevent excessive recirculation through bypass duct 40, thereby protecting HVAC unit 20 from the potential negative consequences of excessive recirculation.

Figure 3:
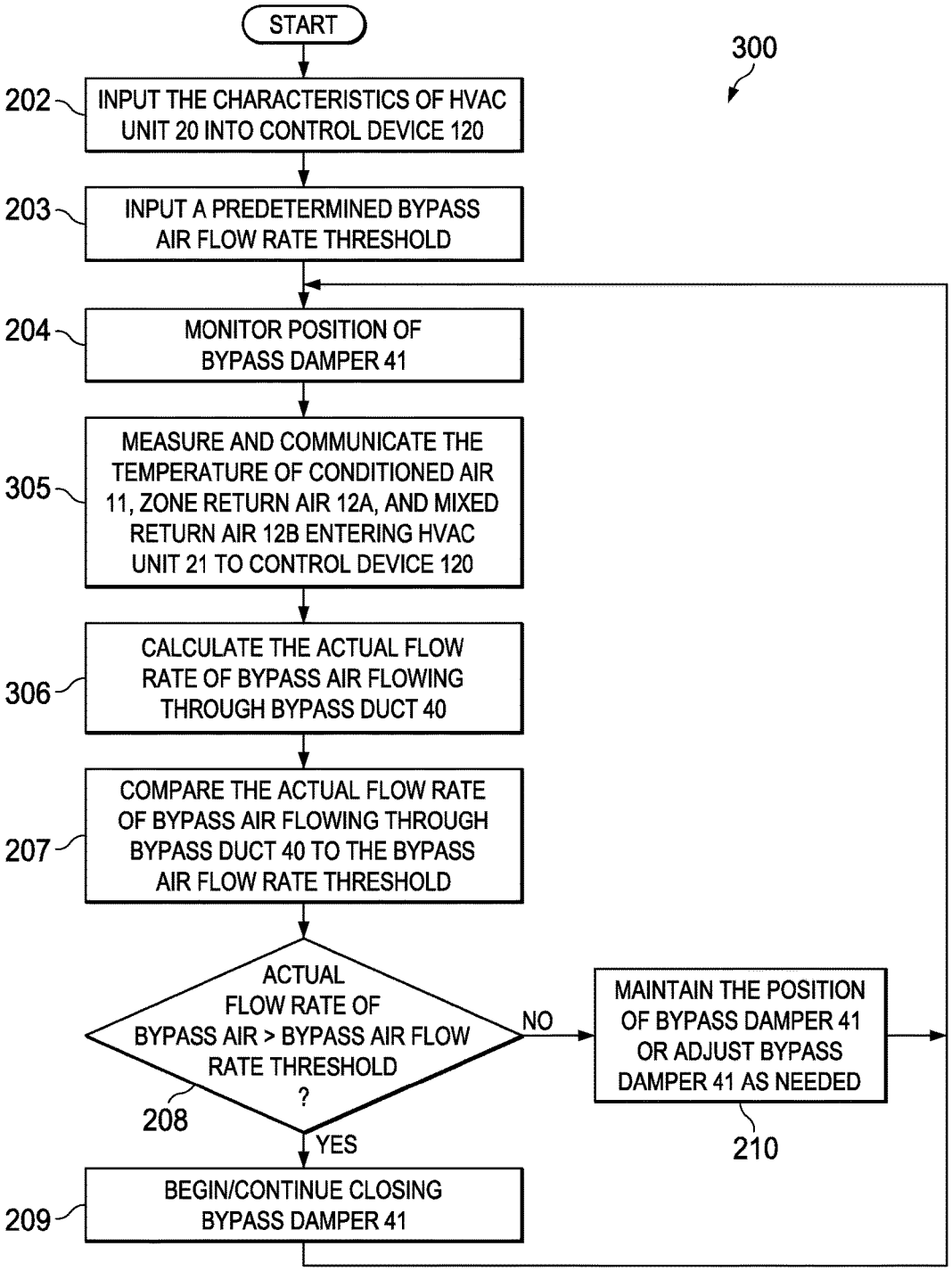
FIG. 3 is a schematic view of an embodiment of a method for automatically and adaptively controlling the active bypass damper of FIG. 1.

Referring now to FIG. 3, an embodiment of a method 300 for automated, adaptive control of the position of bypass damper 41 of HVAC system 10 is shown. Method 300 is similar to method 200 previously described. Namely, method 300 includes blocks 202-204 and 207-210 as previously described. However, in this embodiment, block 201 is absent. In other words, in method 300, the installer of HVAC system 10 (or technician servicing or maintaining HVAC system 10) does not need to input the design characteristics of bypass duct 40 and bypass damper 41 into control device 120. Further, in this embodiment, the pressure differential across bypass damper 41 is not used to calculate the actual flow rate of bypass air flowing through bypass duct 40, and thus, the pressure differential across bypass damper 41 need not be measured or communicated to control device 120. Rather, in method 300, the temperature of conditioned air 11, the temperature of zone return air **12*a* (i.e., the temperature of the return air coming from zones 30, 30', 30" upstream of bypass duct 40), and the temperature of mixed return air 12*b* entering HVAC unit 20 (i.e., the temperature of the return air downstream of bypass duct 40) are used to determine the actual flow rate of bypass air flowing through bypass duct 40. Specifically, during operation of HVAC system 10, supply air temperature sensor 112 measures the temperature of the conditioned air 11 at outlet 21*b* of HVAC unit 20, zone return air temperature sensor 113 measures the temperature of the zone return air 12*a*, and mixed return air temperature sensor 114 measures the temperature of mixed return air 12*b* at inlet 21*a* of HVAC unit 20 in block 305. These measured temperatures are also communicated to control device 120 in block 305. Control device 120 receives the measured temperatures from sensors 112, 113, 114, and uses this data in conjunction with the design characteristics of HVAC unit 20 input in block 202 to calculate the actual flow rate of bypass air flowing through bypass duct 40 using standard industry engineering equations and lookup tables (e.g., Refrigerating and Air-Conditioning Engineers, Inc. (ASHRAE) Handbook equations and lookup charts for "Adiabatic Mixing of Two Moist Airstreams", etc.) in block 306**.

In general, control device 120 may determine of the actual flow rate of bypass air flowing through bypass duct 40 continuously or on a periodic basis (e.g., once a minute). However, similar to method 200 previously described, in this embodiment, the actual flow rate of bypass air flowing through bypass duct 40 is determined by control device 120 on a continuous, real time basis. Following calculation of the actual flow rate of bypass air flowing through bypass duct 40, the remainder of method 300 is the same as method 200 previously described.

Figure 4:
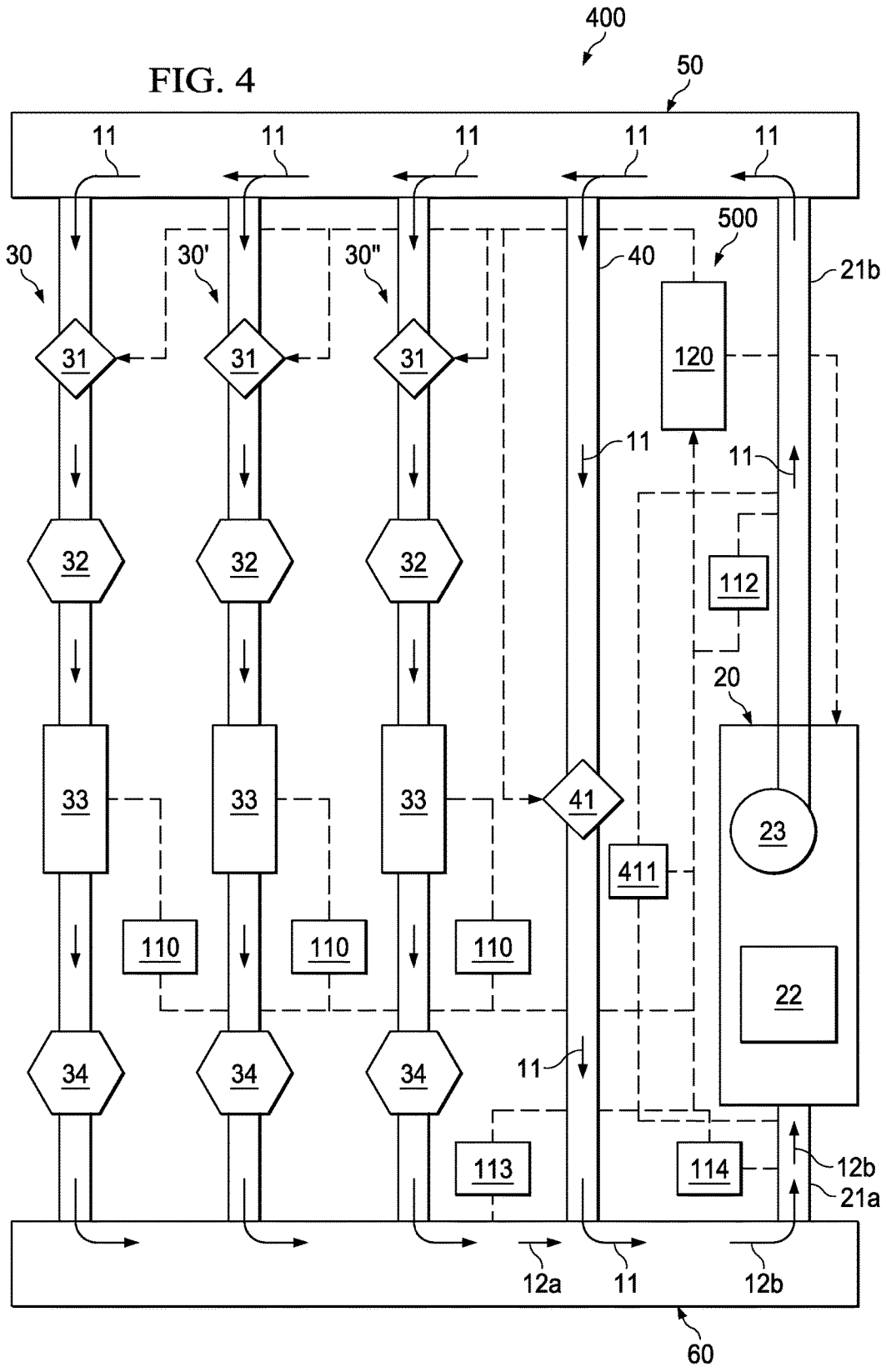
FIG. 4 is a schematic view of an embodiment of a zoned HVAC system in accordance with the principles described herein.

Referring now to FIG. 4, an embodiment of a zoned central HVAC system 400 is schematically shown. HVAC system 400 is substantially the same as HVAC system 10 previously described. Namely, HVAC system 400 includes central HVAC unit 20, zones 30, 30', 30", and bypass duct 40 as previously described. In addition, HVAC system 400 includes a control system 500 that regulates and controls the operation of system 400. Control system 500 includes zone air sensors 110, supply air temperature sensor 112, zone return air temperature sensor 113, mixed return air temperature sensor 114, and control device 120, each as previously described. However, in this embodiment, bypass pressure differential sensor 111 is not included. Instead, an HVAC unit pressure differential sensor 411 is included to measures the pressure differential across HVAC unit 20 (i.e., the pressure differential between inlet 21*a* and outlet 21*b*). In this embodiment, sensor 411 measures the static pressure differential across HVAC unit 20 (i.e., the difference between the static pressure at inlet 21*a* of HVAC unit 20 and the static pressure at outlet 21*b* of HVAC unit 20), however, in other embodiments, the measured pressure differential across the HVAC unit (e.g., HVAC unit 20) may be based on the difference between the velocity pressure at the inlet of the HVAC unit and the velocity pressure at the outlet of the HVAC unit, or based on the difference between the total pressure at the inlet of the HVAC unit and the total pressure at the outlet of the HVAC unit.

Figure 5:
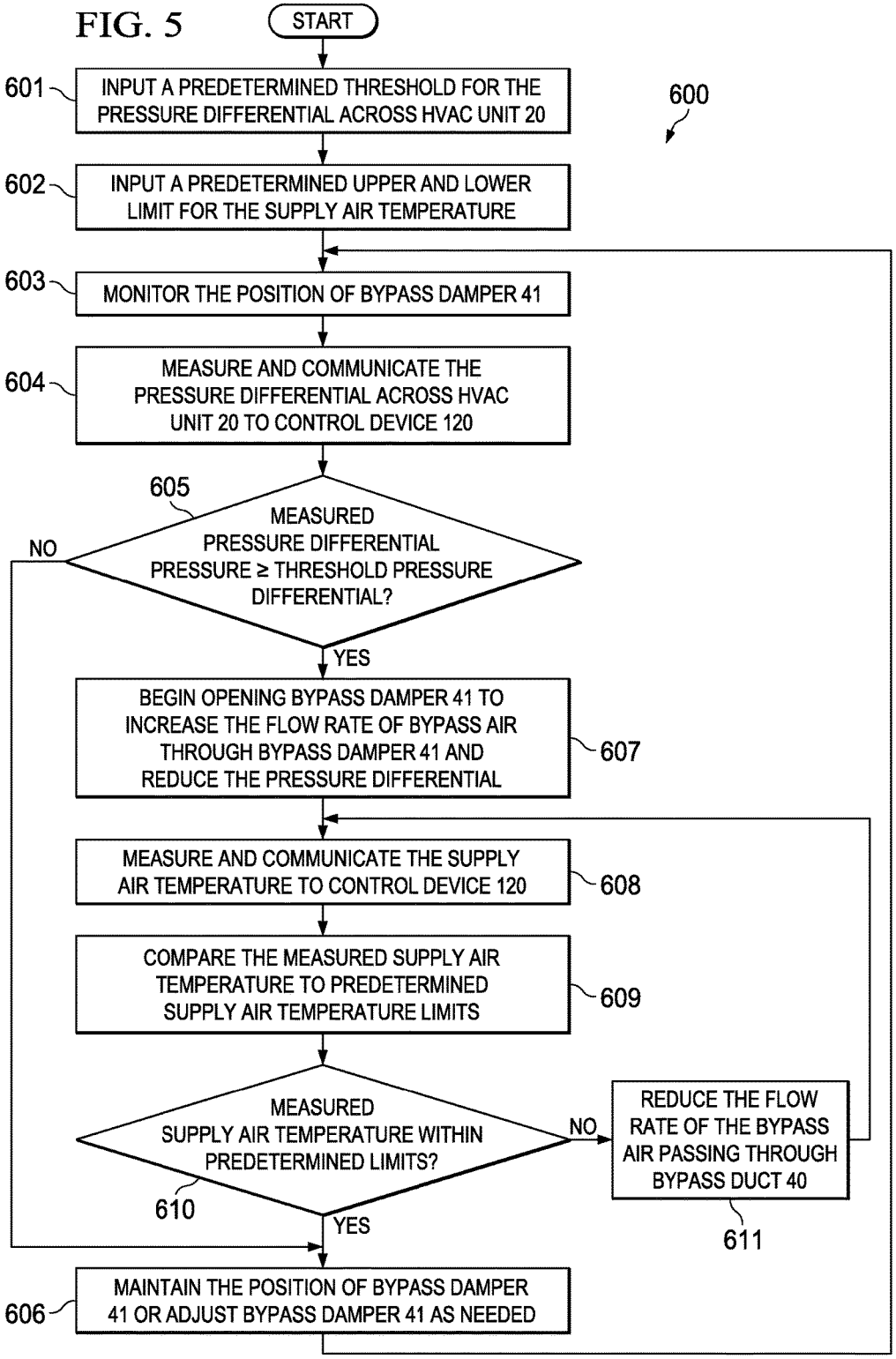
FIG. 5 is a schematic view of an embodiment of a method for automatically and adaptively controlling the flow of bypass air in the system of FIG. 4.

Referring now to FIG. 5, an embodiment of a method 600 for automated, adaptive control of the position of bypass damper 41 of HVAC system 400 is shown. In block 601 of method 600, the installer of HVAC system 400 (or technician servicing or maintaining HVAC system 400) inputs a predetermined threshold for the pressure differential across HVAC unit 20. In general, the predetermined pressure differential threshold corresponds to the maximum acceptable pressure differential across HVAC unit 20. In this embodiment, the maximum acceptable pressure differential across HVAC unit 20 is the pressure differential across HVAC unit 20 at which the undesirable effects of excess air arise (e.g., air noise), and is determined by the HVAC system designer, installer, or technician on a case-by-case basis. The predetermined pressure differential threshold may be determined in any suitable manner. In many cases, the predetermined pressure differential threshold will be based on (a) the design pressure of the ductwork if it was designed based on pressure; (b) experience and industry practices; (c) trial and error; (d) selection from the manufacturer's blower performance data; or combinations thereof. In addition, the installer of HVAC system 400 (or technician servicing or maintaining HVAC system 400) inputs an upper limit and a lower limit for the supply air temperature output by HVAC unit 20 according to block 602. In general, the upper and lower temperature limits define an acceptable supply air operating range for HVAC unit 20, and serve to protect HVAC unit 20 from the undesirable effects of excessive air heating and cooling. Namely, the lower temperature limit is preferably set above the temperature at which coils in climate control system 22 begin to freeze, and the upper temperature limit is preferably set below the temperature at which climate control system 22 may begin to overheat. A safety margin or buffer is preferably provided between the lower temperature limit and the temperature at which undesirable effects of excessive cooling occur, as well as between the upper temperature limit and the temperature at which undesirable effects of excessive heating occur.

During operation of HVAC system 400, control device 120 monitors the position of bypass damper 41 according to block 603. In general, bypass damper 41 may be completely closed, fully opened, or at any number of partially opened positions. In addition, pressure differential sensor 411 measures the pressure differential across HVAC unit 20, and communicates that measured pressure differential to control device 120 according to block 604. Control device 120 receives the measured pressure differential across HVAC unit 20, and compares it to the predetermined threshold for the pressure differential across HVAC unit 20 in block 605. In general, control device 120 may compare the measured pressure differential and the predetermined pressure differential threshold continuously or on a periodic basis (e.g., once a minute). However, in this embodiment, the measured pressure differential across HVAC unit 20 is compared to the predetermined threshold on a continuous, real time basis.

Based on the comparison of the measured pressure differential across HVAC unit 20 and the predetermined threshold for the pressure differential, in block 605, control device 120 determines whether adjustment of the position of bypass damper 41 is necessary. In particular, if the measured pressure differential across HVAC unit 20 is greater than or equal to the predetermined threshold for the pressure differential, thereby indicating the potential for undesirable excess air conditions, then control device 120 instructs bypass damper 41 to begin opening in block 608. Without being limited by this or any particular theory, as bypass damper 41 opens, the flow rate of bypass air through bypass duct 40 increases and the pressure differential across HVAC unit 20 decrease, thereby reducing the likelihood of the undesirable effects of excess air. However, if the measured pressure differential across HVAC unit 20 is less than the predetermined threshold for the pressure differential in block 605, then no further opening of bypass damper 41 is necessary, and thus, control device 120 is free to maintain the position of bypass damper 41, or adjust bypass damper 41 as appropriate depending on the conditions in zones 30, 30', 30", as shown in block 606. Thus, it should also be appreciated that as long as the measured pressure differential across HVAC unit 20 is less than the predetermined threshold for the pressure differential, control device 120 has the option to maintain the position of bypass damper 41, further open bypass damper 41, or further close bypass damper 41 depending on other operating conditions. However, if the measured pressure differential across HVAC unit 20 is substantially the same as the predetermined threshold for the pressure differential, then control device 120 has little to no flexibility to further close bypass damper 41 as a small increase in the pressure differential across HVAC unit 20 may result in undesirable excess air conditions.

As previously described, if the measured pressure differential across HVAC unit 20 is greater than or equal to the predetermined threshold for the pressure differential according to block 605, bypass damper 41 is opened further in block 608. In addition, supply air temperature sensor 112 measures the temperature of the supply air at outlet 21*b* of HVAC unit 20 and communicates the supply air temperature to control device 120 according to block 608. Control device 120 receives the measured supply air temperature, and compares it to the predetermined upper and lower supply air temperatures limits for the supply air in block 609. In general, control device 120 may compare the measured supply air temperature and the upper and lower supply air temperature limits continuously or on a periodic basis (e.g., once a minute). However, in this embodiment, the measured supply air temperature is compared to the upper and lower supply air temperature limits on a continuous, real time basis.

Based on the comparison of the measured supply air temperature and the predetermined upper and lower supply air temperature limits, control device 120 determines whether the flow rate of bypass air through bypass duct 40 is appropriate in block 610. In particular, if the measured supply air temperature is (a) above the upper supply air temperature limit in heating applications, or (b) below the lower supply air temperature limit in cooling applications, it is an indication that recirculation of bypass air through bypass duct 40 is excessive. Accordingly, if the measured supply air temperature is outside the temperature range defined by the upper and lower supply air temperature limits in block 610, control device 120 directs control system 400 to reduce the flow rate of bypass air flowing through bypass duct 40 to protect HVAC unit 20 in block 611. The flow rate of bypass air may be reduced by at least partially closing bypass damper 41, partially opening one or more zone dampers 31, or combinations thereof. In general, control device 120 continues to direct the reduction in the flow rate of bypass air in bypass duct until the measured supply air temperature falls back within acceptable limits (i.e., between the predetermined upper supply air temperature limit and the predetermined lower supply air temperature limit). On the other hand, if the measured supply air temperature is between the predetermined upper and lower supply air temperature limits in block 610, then no further reduction in the flow of bypass air in bypass duct 40 is necessary, and thus, control device 120 is free to maintain the position of bypass damper 41, or adjust bypass damper 41 as appropriate depending on the conditions in zones 30, 30', 30", as shown in block 606. Thus, it should also be appreciated that as long as the measured supply air temperature is between the predetermined upper and lower supply air temperature limits, control device 120 has the option to maintain the position of bypass damper 41, further open bypass damper 41, or further close bypass damper 41 depending on other operating conditions. However, if the measured supply air temperature is substantially the same as the predetermined upper or lower supply air temperature limits, then control device 120 has little to no flexibility to further open bypass damper 41 as a small increase in the flow rate of bypass air through bypass duct 40 may result in excessive bypass air recirculation and associated damage to HVAC unit 20.

Following adjustments of bypass damper 41 and/or zone dampers 31 in blocks 608, 609, 610, 611 to ensure the supply air temperature is within the upper and lower supply air temperature limits, process 600 repeats again beginning with block 603. Thus, during installation and/or servicing of HVAC system 400, blocks 601 and 602 performed to setup or initialize control device 120, however, during actual operation of HVAC system 400, blocks 604-611 are repeated in a closed loop fashion to adaptively control bypass damper 41 to simultaneously prevent problems associated with excess air and excessive recirculation through bypass duct 40, thereby offering the potential to both enhance comfort in spaces 33 and protect HVAC unit 20 from the potential negative consequences of excessive recirculation.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, R1, and an upper limit, Ru, is disclosed, any number falling within the range is specifically disclosed. In particular, the following numbers within the range are specifically disclosed: R=R1+k*(Ru−R1), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. An HVAC system, comprising:

an HVAC unit including a climate control system configured to control the properties of a flow of air passing through the HVAC unit and an air mover adapted to create a pressure differential between an inlet and an outlet of the HVAC unit;

a supply air duct in fluid communication with the outlet of the HVAC unit;

a return air duct in fluid communication with the inlet of the HVAC unit;

a plurality of zones positioned between the supply air duct and the return air duct, wherein each zone includes a climate controlled space;

a bypass duct extending between the supply air duct and the return air duct, wherein the bypass duct includes an active bypass damper having an open position, a closed position, and a plurality of partially opened positions;

a pressure differential sensor configured to measure the pressure differential across the bypass damper; and a control device configured to determine the actual flow rate of the conditioned air flowing through the bypass damper in response to measuring the pressure differential across the bypass damper, calculate a recirculation ratio equal to the ratio of the actual flow rate of the conditioned air flowing through the bypass damper to a nominal flow rate of conditioned air generated by the HVAC unit, compare the calculated recirculation ratio to a bypass air flow threshold, and at least one of (1) adjust the position of the bypass damper in response to determining that the calculated recirculation ratio exceeds the bypass air flow threshold and (2) maintain the position of the bypass damper in response to determining that the calculated recirculation ratio does not exceed the bypass air flow threshold.

2. The HVAC system of claim 1, wherein the control device is configured to receive the measured pressure differential across the bypass damper.

3. The HVAC system of claim 1, wherein the bypass air flow threshold is a maximum recirculation percentage.

4. The HVAC system of claim 1, wherein the bypass air flow threshold is a maximum bypass air flow rate.

5. The HVAC system of claim 1, wherein the control device is configured to receive an input of at least one of (1) one or more characteristics of the bypass duct, (2) one or more characteristics of the bypass damper, and (3) one or more characteristics of the HVAC unit.

6. The HVAC system of claim 5, wherein the control device is configured to use the one or more characteristics of the bypass duct, the one or more characteristics of the bypass damper, and the one or more characteristics of the HVAC unit to determine the actual flow rate of the conditioned air flowing through the bypass damper.

7. An HVAC system, comprising:

an HVAC unit including a climate control system configured to control the properties of conditioned air generated by the HVAC unit and an air mover adapted to create a pressure differential between an inlet and an outlet of the HVAC unit;

a supply air duct in fluid communication with the outlet of the HVAC unit;

a return air duct in fluid communication with the inlet of the HVAC unit;

a plurality of zones positioned between the supply air duct and the return air duct, wherein each zone includes a climate controlled space;

a bypass duct extending between the supply air duct and the return air duct, wherein the bypass duct includes an active bypass damper having an open position, a closed position, and a plurality of partially opened positions;

a pressure differential sensor configured to measure the pressure differential across the HVAC unit;

a supply air temperature sensor adapted to measure the temperature of the conditioned air generated by the HVAC unit; and a control device configured to (1) compare the measured pressure differential across the HVAC unit to a predetermined pressure differential, and adjust a flow rate of the conditioned air generated by the HVAC unit through the bypass duct in response to determining that the measured pressure differential across the HVAC unit is greater than or equal to the predetermined pressure differential and (2) compare the measured temperature of the conditioned air generated by the HVAC unit to a predetermined upper supply air temperature limit and a predetermined lower supply air temperature limit, and adjust the flow rate of the conditioned air generated by the HVAC unit through the bypass duct in response to determining that the measured temperature of the conditioned air flowing from the HVAC unit is outside a temperature range defined by the predetermined upper supply air temperature limit and the predetermined lower supply air temperature limit.

8. The HVAC system of claim 7, wherein the control device is configured to receive the pressure differential across the HVAC unit and the temperature of the conditioned air generated by the HVAC unit.

9. The HVAC system of claim 7, wherein the control device is configured to open the bypass damper if the measured pressure differential across the HVAC unit is greater than the predetermined pressure differential.

10. The HVAC system of claim 7, wherein the control device is configured to increase the flow rate of the conditioned air through the bypass duct if the measured pressure differential across the HVAC unit is greater than the predetermined pressure differential.

11. The HVAC system of claim 7, wherein the control device is configured to close the bypass damper if the measured pressure differential across the HVAC unit is lower than the predetermined pressure differential.

12. The HVAC system of claim 7, wherein the control device is configured to decrease the flow rate of the conditioned air through the bypass duct if the measured temperature is greater than the predetermined upper supply air temperature limit or less than the predetermined lower supply air temperature limit.

13. An HVAC system, comprising:

an HVAC unit including a climate control system configured to control the properties of a flow of air passing through the HVAC unit and an air mover adapted to create a pressure differential between an inlet and an outlet of the HVAC unit;

a supply air duct in fluid communication with the outlet of the HVAC unit;

a return air duct in fluid communication with the inlet of the HVAC unit;

a plurality of zones positioned between the supply air duct and the return air duct, wherein each zone includes a climate controlled space;

a bypass duct extending between the supply air duct and the return air duct, wherein the bypass duct includes an active bypass damper having an open position, a closed position, and a plurality of partially opened positions;

a supply air temperature sensor adapted to measure the temperature of a flow of conditioned air generated by the HVAC unit, a zone return air sensor adapted to measure the temperature of a flow of return air from the at least one zone, and a mixed return air sensor adapted to measure the temperature of a flow of mixed return air entering the inlet of the HVAC unit; and a control device configured to determine the actual flow rate of the conditioned air flowing through the bypass damper in response to measuring (1) the temperature of the conditioned air generated by the HVAC unit, (2) the temperature of a flow of air from the plurality of zones, and (3) the temperature of a flow of air entering an inlet of the HVAC unit, compare the actual flow rate of the conditioned air flowing through the bypass damper to a predetermined air flow rate threshold, and at least one of (1) adjust the position of the bypass damper in response to determining that the actual flow rate of the conditioned air flowing through the bypass damper exceeds the predetermined air flow rate threshold and (2) maintain the position of the bypass damper in response to determining that the actual flow rate of the conditioned air flowing through the bypass damper does not exceed the predetermined air flow rate threshold.

14. The HVAC system of claim 13, wherein the bypass air flow rate threshold is a maximum recirculation percentage.

15. The HVAC system of claim 13, wherein the bypass air flow rate threshold is a maximum bypass air flow rate.

* * * * *